US010808201B2

(12) United States Patent
Oh

(10) Patent No.: US 10,808,201 B2
(45) Date of Patent: Oct. 20, 2020

(54) MANUAL TRANSMISSION OIL COMPOSITION HAVING ENHANCED FRICTIONAL PROPERTIES AND ENABLING IMPROVED FUEL EFFICIENCY

(71) Applicants: HYUNDAI MOTOR COMPANY, Seoul (KR); KIA MOTORS CORPORATION, Seoul (KR)

(72) Inventor: Jung Joon Oh, Seongnam-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 42 days.

(21) Appl. No.: 16/030,057

(22) Filed: Jul. 9, 2018

(65) Prior Publication Data

US 2019/0194570 A1 Jun. 27, 2019

(30) Foreign Application Priority Data

Dec. 22, 2017 (KR) ..... 10-2017-0178529

(51) Int. Cl.
*C10M 169/04* (2006.01)
*C10M 145/14* (2006.01)
(Continued)

(52) U.S. Cl.
CPC ..... *C10M 169/044* (2013.01); *C10M 145/14* (2013.01); *C10M 157/04* (2013.01); *C10M 169/041* (2013.01); *C10M 2203/003* (2013.01); *C10M 2203/1025* (2013.01); *C10M 2209/084* (2013.01); *C10M 2215/086* (2013.01); *C10M 2217/06* (2013.01); *C10M 2219/046* (2013.01);
(Continued)

(58) Field of Classification Search
CPC ..... C10M 169/044; C10M 2209/084; C10M 145/14; C10M 157/04; C10M 169/041; C10M 2203/003; C10M 2203/1025; C10M 2215/086; C10M 2217/06; C10M 2219/046; C10M 2223/045; C10N 2030/02; C10N 2030/04; C10N 2030/06; C10N 2030/54; C10N 2040/044
See application file for complete search history.

(56) References Cited

U.S. PATENT DOCUMENTS 8,067,349 B2 * 11/2011 Stoehr ..... C08F 290/04 508/469
2003/0036488 A1 * 2/2003 Yuki ..... C10M 145/14 508/469
2018/0187120 A1 * 7/2018 Oh ..... C10M 129/34

FOREIGN PATENT DOCUMENTS

KR 10-0298035 B1 9/2001
KR 10-0706434 B1 4/2007
(Continued)

*Primary Examiner* — James C Goloboy
(74) *Attorney, Agent, or Firm* — Morgan, Lewis & Bockius LLP

(57) ABSTRACT

A manual transmission oil composition includes: polyisobutenyl succinimide serving as a detergent-dispersant; and comb polymethacrylate (comb PMA), which has at least one of polar and nonpolar branches connected to a main chain thereof, and serves as a viscosity modifier. Polyisobutenyl succinimide is contained in an amount of 1 wt % to 5 wt % based on a total weight of the manual transmission oil composition, W and comb PMA is contained in an amount of 4 wt % to 12 wt % based on the total weight of the manual transmission oil composition.

5 Claims, 1 Drawing Sheet

<Polyisobutenyl succinimide>

<Olefin Amide Comb PMA>

(51) Int. Cl.

| | |
|---|---|
| ***C10M 157/04*** | (2006.01) |
| ***C10N 30/02*** | (2006.01) |
| ***C10N 30/04*** | (2006.01) |
| ***C10N 30/06*** | (2006.01) |
| ***C10N 30/00*** | (2006.01) |
| ***C10N 40/04*** | (2006.01) |

(52) U.S. Cl.
CPC ... *C10M 2223/045* (2013.01); *C10N 2030/02* (2013.01); *C10N 2030/04* (2013.01); *C10N 2030/06* (2013.01); *C10N 2030/54* (2020.05); *C10N 2040/044* (2020.05)

(56) References Cited

FOREIGN PATENT DOCUMENTS

| | | | |
|---|---|---|---|
| KR | 10-2008-0109877 | A | 12/2008 |
| WO | WO-2015142482 | A1 * | 9/2015 |

* cited by examiner

[FIG.1]
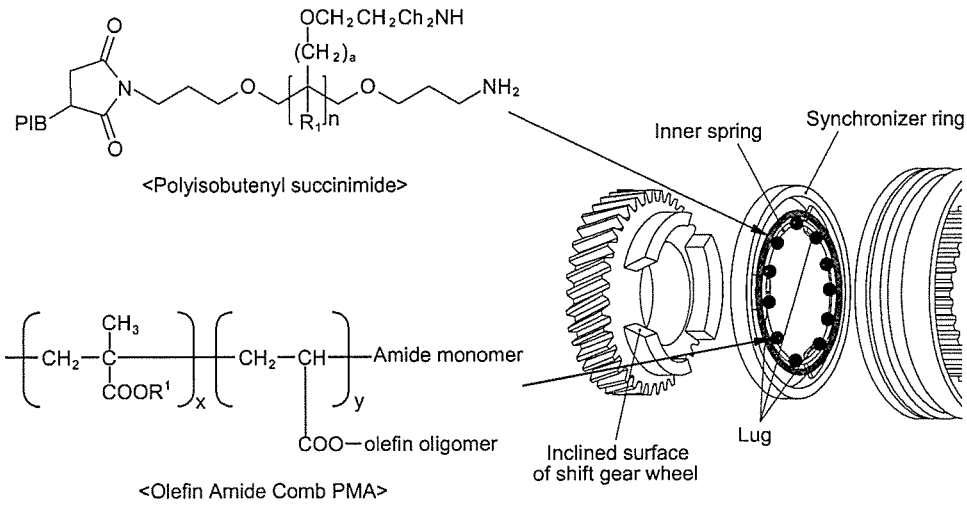
[FIG.2]
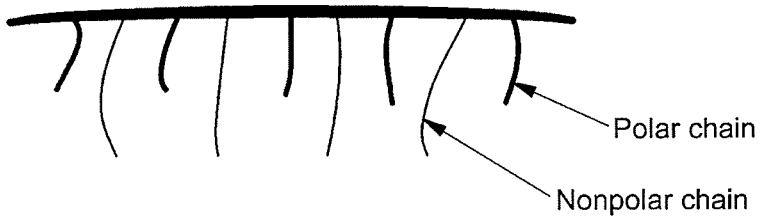

MANUAL TRANSMISSION OIL COMPOSITION HAVING ENHANCED FRICTIONAL PROPERTIES AND ENABLING IMPROVED FUEL EFFICIENCY

CROSS-REFERENCE TO RELATED APPLICATION

The present application claims priority to Korean Patent Application No. 10-2017-0178529 filed on Dec. 22, 2017, the entire contents of which is incorporated herein for all purposes by this reference.

TECHNICAL FIELD

The present disclosure relates to a low-viscosity manual transmission oil composition having enhanced frictional properties and improved fuel efficiency, and more particularly, to a manual transmission oil composition including polyisobutenyl succinimide, which serves as a detergent-dispersant, and comb polymethacrylate (comb PMA), which serves as a viscosity modifier, having at least one of polar and nonpolar branches connected to a main chain thereof.

BACKGROUND

A transmission is a device that is installed between a clutch and a propeller shaft or between a clutch and a final reduction gear device so as to change power of an engine into a rotational force and speed that match running conditions of a vehicle, the force and speed then being transmitted to vehicle wheels. A manual transmission functions to change the rotational speed and the rotational force transferred from the engine by performing gear shifting in consideration of the running conditions, in conjunction with operation of the clutch, which is necessary for controlling power, the speed and force then being transmitted to the vehicle wheels, thereby providing the speed and torque required by a driver.

In recent years, the regulations for exhaust gas emitted from vehicles, such as carbon dioxide, etc., have become more stringent in order to encourage the efficient use of energy and to prevent global warming. In response to such environmental regulations, the development of fuel-efficiency-improved engine/transmission oil that may reduce the amount of energy lost by the engine has been actively carried out.

In particular, lowering the viscosity of the engine/transmission oil may minimize the energy loss due to fluid resistance when power is transferred. However, when the viscosity is lowered, the oil membrane becomes thin and thus intermetallic friction increases, which may deteriorate durability.

Specifically, in the conventional engine/transmission oil, when the viscosity of the oil excessively increases, contact friction may interfere with synchronization, which thus deteriorates the shifting sensation and decreases fuel efficiency. On the other hand, when the viscosity of the oil is excessively lowered, the oil membrane becomes thin and gear wear is increased, resulting in decreased durability.

It is thus necessary to develop a manual transmission oil composition, which is capable of maintaining durability while reducing high-/low-temperature viscosity of the manual transmission oil, and which is also capable of increasing the friction coefficient of the synchronizer of the manual transmission to thus improve shifting efficiency.

SUMMARY

An objective of the present disclosure is to provide a manual transmission oil composition that is capable of maintaining durability while reducing high-/low-temperature viscosity of the manual transmission oil and is also capable of increasing the friction coefficient of the synchronizer of the manual transmission to thus enhance the fuel efficiency of the manual transmission vehicle through an improvement in shifting efficiency.

An aspect of the present disclosure is to provide a manual transmission oil composition, comprising polyisobutenyl succinimide, serving as a detergent-dispersant, and comb polymethacrylate (comb PMA) having at least one of polar and nonpolar branches connected to a main chain thereof, serving as a viscosity modifier.

Another aspect of the present disclosure is to provide a manual transmission oil composition, which includes the components polyisobutenyl succinimide and comb PMA in combination ratio or amounts that cannot be expected by those skilled in the art.

Still another aspect of the present disclosure is to provide manual transmission oil having an average kinematic viscosity of 19 to 22 cSt at 40° C. and a dynamic friction coefficient of 0.083 to 0.095 under conditions of 1200 rpm, 41 kgf and 80° C.

An exemplary embodiment of the present disclosure provides a manual transmission oil composition, comprising polyisobutenyl succinimide, serving as a detergent-dispersant; and comb polymethacrylate (comb PMA) having at least one of polar and nonpolar branches connected to a main chain thereof, serving as a viscosity modifier.

In the manual transmission oil composition according to an embodiment of the present disclosure, polyisobutenyl succinimide is contained in an amount of 1 wt % to 5 wt % based on the total weight of the manual transmission oil composition, and comb PMA is contained in an amount of 4 wt % to 12 wt % based on the total weight of the manual transmission oil composition.

In the manual transmission oil composition according to an embodiment of the present disclosure, the weight ratio of polyisobutenyl succinimide:comb PMA is 1 to 5:4 to 12.

In the manual transmission oil composition according to an embodiment of the present disclosure, comb PMA is olefin amide comb polymethacrylate.

The manual transmission oil composition according to an embodiment of the present disclosure further comprises at least one additive selected from the group consisting of an antiwear additive, a friction modifier, an extreme pressure additive, and an antioxidant.

In the manual transmission oil composition according to an embodiment of the present disclosure, the antiwear additive is zinc alkyl dithiophosphate, and the zinc alkyl dithiophosphate is contained in an amount of 3 wt % to 5 wt % based on the total weight of the composition.

The manual transmission oil composition according to an embodiment of the present disclosure includes, based on the total weight thereof, 80 to 90 wt % of base oil, 1 to 5 wt % of polyisobutenyl succinimide, serving as a detergent-dispersant, 4 to 12 wt % of comb polymethacrylate (comb PMA) having at least one of polar and nonpolar branches connected to a main chain thereof, serving as a viscosity modifier, and 3 to 5 wt % of zinc alkyl dithiophosphate, serving as an antiwear additive.

In addition, another exemplary embodiment of the present disclosure provides a manual transmission oil, comprising the composition according to any one of the aforementioned embodiments and having an average kinematic viscosity of 19 to 22 cSt at 40° C. and a dynamic friction coefficient of 0.083 to 0.095 under conditions of 1200 rpm, 41 kgf and 80° C.

According to the present disclosure, the manual transmission oil composition is effective at enhancing both frictional properties and fuel efficiency.

According to the present disclosure, the manual transmission oil composition is effective at decreasing fluid resistance by maximizing a reduction in kinematic viscosity at 40° C. and is also effective at maximizing improvements in transfer efficiency and fuel efficiency (increase by 0.5%) by increasing the friction coefficient between a gear and a friction material used for the synchronizer ring of a manual transmission.

According to the present disclosure, the manual transmission oil composition is effective at minimizing energy loss attributed to slippage when the functional groups of two components polyisobutenyl succinimide and comb PMA are attached to the synchronizer friction material to thus hold the opposite gear.

The effects of the present disclosure are not limited to the foregoing, and should be understood to include all reasonably possible effects in the following description.

BRIEF DESCRIPTION OF DRAWINGS

FIG. 1 shows effects of components of a composition according to an embodiment of the present disclosure on a manual transmission; and FIG. 2 schematically shows comb polymethacrylate (comb PMA) having at least one of polar and nonpolar branches connected to a main chain thereof, which is a viscosity modifier according to the present disclosure.

DESCRIPTION OF SPECIFIC EMBODIMENTS

According to the present disclosure, as shown in FIG. 1, (A) polyisobutenyl succinimide, which is a friction modifier that is not been used in existing products, and (B) an olefin amide comb polymethacrylate (PMA) viscosity modifier, having superior high-/low-temperature viscosity reduction properties, are combined at a specific mixing ratio, thus maximizing a reduction in kinematic viscosity at 40° C. to thereby decrease fluid resistance and increasing the friction coefficient between a gear and a friction material used for the synchronizer ring of a manual transmission to thereby maximize improvements in transfer efficiency and fuel efficiency (by 0.5%). When the functional groups of the two components (A) and (B) are attached to the synchronizer friction material to thus hold the opposite gear, energy loss due to slippage may be minimized.

A description of the configuration and functions of the present disclosure is omitted if it is determined that the gist of the present disclosure would be made unclear thereby. As used herein, the term "comprising" or "including" means that other elements may be included unless otherwise specified.

In the present specification, when a range is described for a variable, it will be understood that the variable includes all values including the end points described within the stated range. For example, the range of "5 to 10" will be understood to include any subranges, such as 6 to 10, 7 to 10, 6 to 9, 7 to 9, and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Further, the range of "10% to 30%" will be understood to include any subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

The "base oil" described herein is a basic constituent of a lubricating oil composition.

The "detergent-dispersant" described herein suppresses wear and deposition of oxides and sludge in the engine/transmission system, and also affects frictional properties and the like.

The "viscosity modifier" described herein alters the high-/low-temperature viscosities, and is able to vary the low-temperature fluidity properties depending on the type thereof.

The "antiwear additive" described herein is able to form a protective film on the metal surface that is subjected to friction in order to prevent wear.

Hereinafter, a detailed description will be given of the present disclosure.

An embodiment of the present disclosure addresses a manual transmission oil composition comprising (A) polyisobutenyl succinimide, serving as a detergent-dispersant, and (B) comb polymethacrylate (comb PMA) having at least one of polar and nonpolar branches connected to a main chain thereof, serving as a viscosity modifier.

The component (A) may be represented by Chemical Formula 1 below.

[Chemical Formula 1]

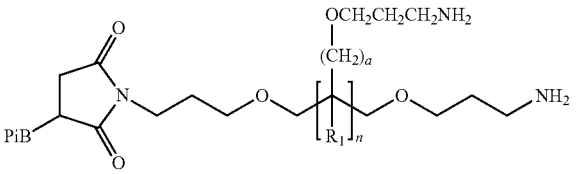

The component (B) is configured such that at least one of polar and nonpolar branches is connected to a typical comb polymethacrylate (comb PMA), and may be schematically represented as shown in FIG. 2.

In the manual transmission oil composition according to an embodiment of the present disclosure, the component (A) is contained in an amount of 1 wt % to 5 wt % based on the total weight of the manual transmission oil composition, and the component (B) is contained in an amount of 4 wt % to 12 wt % based on the total weight of the manual transmission oil composition.

When the amounts of the components (A) and (B) fall in the above ranges, both frictional properties and fuel efficiency may be enhanced. If the amount of the component (A) is less than 1 wt %, detergency may deteriorate. On the other hand, if the amount thereof exceeds 5 wt %, a friction coefficient may decrease, and thus durability may worsen. Moreover, if the amount of the component (B) is less than 4 wt %, a fuel-economy effect may become insignificant due to the low viscosity reduction effects. On the other hand, if the amount thereof exceeds 12 wt %, low-temperature viscosity may increase, and thus low-temperature operating performance may deteriorate.

In the manual transmission oil composition according to an embodiment of the present disclosure, the weight ratio of (A):(B) is 1 to 5:4 to 12.

When the weight ratio of (A) and (B) falls in the above range, both frictional properties and fuel efficiency may be enhanced.

In the manual transmission oil composition according to an embodiment of the present disclosure, the component (B) is olefin amide comb polymethacrylate.

The olefin amide comb polymethacrylate may be represented by Chemical Formula 2 below.

[Chemical Formula 2]

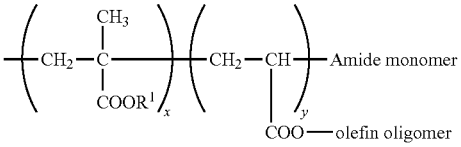

The manual transmission oil composition according to an embodiment of the present disclosure may further comprise at least one additive selected from the group consisting of an antiwear additive, a friction modifier, an extreme pressure additive, and an antioxidant.

In the manual transmission oil composition according to an embodiment of the present disclosure, the antiwear additive zinc is zinc alkyl dithiophosphate, and the alkyl dithiophosphate is contained in an amount of 3 wt % to 5 wt % based on the total weight of the composition.

When the amount of the zinc alkyl dithiophosphate falls in the range of 3 wt % to 5 wt %, both frictional properties and fuel efficiency may be enhanced. If the amount of the zinc alkyl dithiophosphate is less than 3 wt %, antiwear performance may deteriorate. On the other hand, if the amount thereof exceeds 5 wt %, friction performance may deteriorate.

The manual transmission oil composition according to an embodiment of the present disclosure may comprise, based on the total weight of the composition, 80 to 90 wt % of base oil, to 5 wt % of polyisobutenyl succinimide, serving as a detergent-dispersant, 4 to 12 wt % of comb polymethacrylate (comb PMA) having at least one of polar and nonpolar branches connected to a main chain thereof, serving as a viscosity modifier, and 3 to 5 wt % of zinc alkyl dithiophosphate, serving as an antiwear additive.

As the base oil, a base oil of Gr. III or more specified by API and having an average kinematic viscosity of 3.8 to 4.2 cSt and 2.8 to 3.2 cSt at 100° C. and a viscosity index of 100 or more can be used.

Another embodiment of the present disclosure addresses a manual transmission oil, comprising the composition according to any one of the aforementioned embodiments and an average kinematic viscosity of 19 to 22 cSt at 40° C. and a dynamic friction coefficient of 0.083 to 0.095 under conditions of 1200 rpm, 41 kgf and 80° C.

A better understanding of the present disclosure will be given through the following test example and examples, which are merely set forth to illustrate but are not to be construed as limiting the scope of the present disclosure.

EXAMPLES 1 to 10 and COMPARATIVE EXAMPLES 1 to 11

The manual transmission oil compositions of Examples 1 to 10 were prepared using components in the amounts shown in Tables 1 and 2 below, and the manual transmission oil compositions of Comparative Examples 1 to 11 were prepared using components in the amounts shown in Tables 3 and 4 below.

Table 1 below shows the compositions of Examples 1 to 5 prepared using the polyisobutenyl succinimide detergent-dispersant in an amount of 3 wt % and the olefin amide comb PMA viscosity modifier in amounts of 4, 6, 8, 10 and 12 wt %.

TABLE 1

| Classification (wt %) | | Example 1 | 2 | 3 | 4 | 5 |
|---|---|---|---|---|---|---|
| Base oil | Gr. III; Yubase 3, 4 (made by SK) | 90 | 88 | 86 | 84 | 82 |
| Detergent-dispersant | Calcium sulfonate (made by Lubrizol) | — | — | — | — | — |
| | Polyisobutenyl succinimide (made by Lubrizol) | 3 | 3 | 3 | 3 | 3 |
| Viscosity modifier | PMMA (made by Lubrizol) | — | — | — | — | — |
| | Typical Comb PMA (made by Rohmax) | — | — | — | — | — |
| | Olefin amide Comb PMA (made by Sanyo) | 4 | 6 | 8 | 10 | 12 |
| | SBR (made by Lubrizol) | — | — | — | — | — |
| Antiwear additive | Zinc alkyl dithiophosphate (made by Lubrizol) | 3 | 3 | 3 | 3 | 3 |

Table 2 below shows the compositions of Examples 6 to 10, prepared using the polyisobutenyl succinimide detergent-dispersant in amounts of 1, 2, 3, 4 and 5 wt %, and the olefin amide comb PMA viscosity modifier in an amount of 8 wt %.

TABLE 2

| Classification (wt %) | | Example 6 | 7 | 8 | 9 | 10 |
|---|---|---|---|---|---|---|
| Base oil | Gr. III; Yubase 3, 4 (made by SK) | 88 | 87 | 86 | 85 | 84 |
| Detergent-dispersant | Calcium sulfonate (made by Lubrizol) | — | — | — | — | — |
| | Polyisobutenyl succinimide (made by Lubrizol) | 1 | 2 | 3 | 4 | 5 |
| Viscosity modifier | PMMA (made by Lubrizol) | — | — | — | — | — |
| | Typical Comb PMA (made by Rohmax) | — | — | — | — | — |
| | Olefin amide Comb PMA (made by Sanyo) | 8 | 8 | 8 | 8 | 8 |
| | SBR (made by Lubrizol) | — | — | — | — | — |
| Antiwear additive | Zinc alkyl dithiophosphate (made by Lubrizol) | 3 | 3 | 3 | 3 | 3 |

Table 3 below shows the compositions of Comparative Examples 1 to 6.

TABLE 3

| Classification (wt %) | | Comparative Example 1 | 2 | 3 | 4 | 5 | 6 |
|---|---|---|---|---|---|---|---|
| Base oil | Gr. III; Yubase 3, 4 (made by SK) | 83 | 85 | 81 | 83 | 92 | 80 |
| Detergent-dispersant | Calcium sulfonate (made by Lubrizol) | 4 | 4 | 4 | 4 | — | — |
| | Polyisobutenyl succinimide (made by Lubrizol) | — | — | — | — | 3 | 3 |
| Viscosity modifier | PMMA (made by Lubrizol) | 10 | — | — | — | — | — |
| | Typical Comb PMA (made by Rohmax) | — | — | — | 10 | — | — |
| | Olefin amide Comb PMA (made by Sanyo) | — | 8 | — | — | 2 | 14 |
| | SBR (made by Lubrizol) | — | — | 12 | — | — | — |
| Antiwear additive | Zinc alkyl dithiophosphate (made by Lubrizol) | 3 | 3 | 3 | 3 | 3 | 3 |

Table 4 below shows the compositions of Comparative Examples 7 to 11.

TABLE 4

| Classification (wt %) | | Comparative Example 7 | 8 | 9 | 10 | 11 |
|---|---|---|---|---|---|---|
| Base oil | Gr. III; Yubase 3, 4 (made by SK) | 84 | 82 | 84 | 88.5 | 83 |
| Detergent-dispersant | Calcium sulfonate (made by Lubrizol) | — | — | — | — | — |
| | Polyisobutenyl succinimide (made by Lubrizol) | 3 | 3 | 3 | 0.5 | 6 |
| Viscosity modifier | PMMA (made by Lubrizol) | 10 | — | — | — | — |
| | Typical Comb PMA (made by Rohmax) | — | — | 10 | — | — |
| | Olefin amide Comb PMA (made by Sanyo) | — | — | — | 8 | 8 |
| | SBR (made by Lubrizol) | — | 12 | — | — | — |
| Antiwear additive | Zinc alkyl dithiophosphate (made by Lubrizol) | 3 | 3 | 3 | 3 | 3 |

Test Example: Measurement of Properties

The properties of the manual transmission oils of Examples 1 to 10 and Comparative Examples 1 to 11 were measured through the following methods. The results are shown in Tables 5 and 6 below.

(1) A synchro dynamic friction coefficient was determined by measuring the dynamic friction between a friction material and a steel plate under conditions of 1200 rpm, 41 kgf and 80° C.

(2) A 40° C. kinematic viscosity was measured in accordance with ASTM D445.

(3) A fuel efficiency improvement was measured in an FTP 75 mode for vehicle fuel economy. The above fuel efficiency measurement method is identical to CVS 75, which is the Korea
Certified Fuel Economy Test Mode (4) Fe wear after durability testing was evaluated for 700 hr under conditions of an engine speed of 260 to 1600 rpm, a torque of 300 to 2000N, and shifting from gears 1 to 6.

TABLE 5

| Evaluation item | Example 1 | 2 | 3 | 4 | 5 | Comparative Example 1 | 2 | 3 | 4 | 5 | 6 |
|---|---|---|---|---|---|---|---|---|---|---|---|
| Synchro dynamic friction coefficient | 0.09 | 0.09 | 0.09 | 0.09 | 0.09 | 0.08 | 0.08 | 0.08 | 0.08 | 0.085 | 0.085 |
| 40° C. kinematic viscosity | 23 | 22 | 20 | 20 | 19 | 25 | 23 | 26 | 23 | 25 | 24 |
| Fuel efficiency improvement (%) | 0.2 | 0.3 | 0.5 | 0.4 | 0.3 | Standard | 0 | −0.1 | 0 | 0 | 0 |
| Fe wear after durability testing (ppm) | 140 | 140 | 130 | 140 | 140 | 150 | 160 | 180 | 160 | 150 | 150 |

TABLE 6

| | Example | | | | | Comparative Example | | | | |
|---|---|---|---|---|---|---|---|---|---|---|
| Evaluation item | 6 | 7 | 8 | 9 | 10 | 7 | 8 | 9 | 10 | 11 |
| Synchro dynamic friction coefficient | 0.082 | 0.083 | 0.09 | 0.091 | 0.089 | 0.085 | 0.085 | 0.083 | 0.082 | 0.086 |
| 40° C. kinematic viscosity | 21 | 21 | 20 | 20 | 20 | 23 | 26 | 23 | 23 | 23 |
| Fuel efficiency improvement (%) | 0.1 | 0.2 | 0.5 | 0.4 | 0.3 | 0 | 0 | 0 | 0 | 0 |
| Fe wear after durability testing (ppm) | 120 | 120 | 100 | 120 | 110 | 160 | 160 | 165 | 170 | 155 |

As is apparent from the above test results, when the amount of olefin amide comb PMA was 4 to 12 wt % (Examples 1 to 5) and when the amount of polyisobutenyl succinimide was 1 to 5 wt % (Examples 6 to 10), an improvement in fuel efficiency and decreased wear, determined after durability testing, were exhibited.

In particular, the 40° C. kinematic viscosity was minimized and the dynamic friction coefficient was maximized at a particular ratio of olefin amide comb PMA and polyisobutenyl succinimide (8:3 wt %=2.67:1), thus maximizing vehicle fuel economy improvement and durability enhancement (Examples 3 and 8).

When the amounts of the two components are less than the above ranges, the attachment power of a friction material may decrease, thus reducing a fuel-economy effect due to slippage.

On the other hand, when the amounts thereof exceed the above ranges, the resistance between the two components may increase, and thus the fuel-economy effect is somewhat decreased (Comparative Examples 5, 6, 10, and 11).

When the two components are used together with different viscosity modifiers (PMA, Comb PMA, SBR etc.) or different dispersants, the 40° C. kinematic viscosity reduction and the friction coefficient improvement become insignificant, and thus there is no fuel-economy effect (Comparative Examples 1, 2, 3, 4, 7, 8, and 9).

Therefore, according to the present disclosure, the olefin amide comb PMA (OACP) viscosity modifier, in which the length between side chains linked to the main chain is varied and thus low-temperature shrinkage and high-temperature expansion may be maximized, and polyisobutenyl succinimide, which is a kind of detergent-dispersant, are combined at a specific mixing ratio, thereby decreasing the 40° C. kinematic viscosity and increasing the friction coefficient of the synchronizer friction material of a manual transmission, ultimately maximizing improvements in transfer efficiency and fuel efficiency. The functional groups of the two components are attached to the synchronizer ring friction material to thus increase the dynamic friction coefficient, thereby minimizing the energy loss due to slippage when shifting gears.

Although the exemplary embodiments of the present disclosure have been disclosed for illustrative purposes, those skilled in the art will appreciate that various modifications, additions, and substitutions are possible, without departing from the scope and spirit of the invention as disclosed in the accompanying claims.

What is claimed is:

1. A manual transmission oil composition, comprising, based on a total weight of the manual transmission oil composition:

82 to 90 wt % of base oil;

1 to 5 wt % of polyisobutenyl succinimide serving as a detergent-dispersant;

4 to 12 wt % of olefin amide comb polymethacrylate (PMA), which has olefin and amide branches connected to a main chain thereof, and serves as a viscosity modifier, and 3 wt % of zinc alkyl dithiophosphate, serving as an antiwear additive, wherein a weight ratio of polyisobutenyl succinimide: olefin amide comb PMA is 1 to 5:4 To 12.

2. The manual transmission oil composition of claim 1, further comprising at least one additive selected from the group consisting of an antiwear additive, a friction modifier, an extreme pressure additive, and an antioxidant.

3. A manual transmission oil, comprising a composition of claim 1 and having an average kinematic viscosity of 19 to 22 cSt at 40° C. and a dynamic friction coefficient of 0.083 to 0.095 under conditions of 1200 rpm, 41 kgf and 80° C.

4. A manual transmission oil, comprising the composition of claim 1 and having an average kinematic viscosity of 19 to 22 cSt at 40° C. and a dynamic friction coefficient of 0.083 to 0.095 under conditions of 1200 rpm, 41 kgf and 80° C.

5. A manual transmission oil, comprising the composition of claim 1 and having an average kinematic viscosity of 19 to 22 cSt at 40° C. and a dynamic friction coefficient of 0.083 to 0.095 under conditions of 1200 rpm, 41 kgf and 80° C.

* * * * *